US005203127A

United States Patent [19]

Olthoff et al.

[11] Patent Number: 5,203,127

[45] Date of Patent: Apr. 20, 1993

[54] EARTH ANCHOR

[76] Inventors: John R. Olthoff, 740 Eastridge, N.E., Grand Rapids, Mich. 49506; Wayne L. Nichols, Jr., 5960 Myers Lake Rd., Belmont, Mich. 49306; Rick A. Harmon, 623 N. 11th St., Canton, Ill. 61520; Charles L. Duncan, 619 S. Chestnut, Lewistown, Ill. 61542

[21] Appl. No.: 722,833

[22] Filed: Jun. 28, 1991

[51] Int. Cl.[5] ..... E04G 23/02; E02D 5/74

[52] U.S. Cl. ..... 52/161; 52/162; 52/293; 52/742; 47/55

[58] Field of Search ..... 52/742, 161, 162, 163, 52/169.1, 293; 47/55, 57

[56] References Cited

U.S. PATENT DOCUMENTS

| | | | |
|---|---|---|---|
| 809,032 | 1/1906 | Swortfiger | 52/161 |
| 4,453,845 | 6/1984 | Donan, Jr. | 52/161 |
| 4,970,835 | 11/1990 | Harmon | 52/742 |

*Primary Examiner*—David A. Scherbel
*Assistant Examiner*—Wynn Wood

[57] ABSTRACT

An expandable earth anchor is provided with pivoted arms that remain contracted about a bolt rod as the rod, together with the anchor, is driven into the earth. Rotation of the rod with respect to the anchor induces an initial degree of expansion by rotation of the anchor arms about their pivot connection, followed by full expansion of the arms induced by movement of the bolt rod as a result of rotation of a bearing nut against a plate. Arrangements are provided for the expansion of a plurality of anchor devices on a single bolt rod, rendering the system suitable for various types of soils.

10 Claims, 7 Drawing Sheets

EARTH ANCHOR

BACKGROUND OF THE INVENTION

This invention provides an earth anchor that has been developed primarily in conjunction with the stabilizing and re-positioning of basement walls that are in danger of being displaced by outside earth pressure. In freezing conditions, soil moisture solidifies, and expands with tremendous force. In warmer weather, the thawing ground relaxes the pressure, and sometimes withdraws as it contracts. The resulting gap can easily become at least partially filled, causing a renewed pressure layer against the already displaced basement wall when the ground freezes again. Resulting cracks in the wall invite the invasion of ground water into the basement, which is another factor that has focused attention on the problem of wall instability.

Attempts have been made to stabilize basement walls against further displacement, and even return them to a vertical plane. One expedient (shown in the Johnson, et al, U.S. Pat. No. 4,189,891) involves digging an excavation at some distance out from the wall, and drilling a hole through the wall opposite the excavation. A rod is then driven through the earth from this hole, which is secured to some object deposited in the excavation. The excavation is then filled in, and the rod can function as a long bolt terminating inside the wall at a nut and a bearing plate. A much simpler system is described in the Harmon U.S. Pat. No. 4,970,835, issued on Nov. 20, 1990. This system requires no excavation, and replaces the buried terminal with an expandable earth anchor inserted in the hole in the basement wall, and driven out into the earth with the bolt rod. Pulling on the rod by tightening the nut against a bearing plate inside the basement wall opens the anchor device ultimately to a fully expanded position. In both of these systems, the bearing nuts can be periodically tightened to re-position the wall. An anchor device of this type can be expected to be inserted in a variety of different types of soil, ranging from solid clay, to pure sand. As the anchor is forced through the soil on installation, it will tend to produce a well-defined hole in a solid clay-type soil. With sand, however, the hole is less well-defined. It tends to fall back around the bolt rod as the anchor device is forced into position. The return pull on the rod by tightening the nut inside the basement wall causes the anchor device to readily dig into the loose soil, but can conceivably pull it right back through the hole that it has formed in a more solid soil. A need has been found for assuming an initial expansion of the anchor device sufficient to dig it into the walls defining the hole, regardless of whether or not the earth has tended to fill in behind the anchor as it was driven into position. The structure of these anchors centers in a threaded central portion to which arms are pivotally connected, and which trail from the pivot connection back along the bolt rod as the anchor is driven. On opposite movement of the bolt rod, however, they are opened by earth pressure into a position approaching 90° from the axis of the rod, where a stop limits further rotation. The problem here is to provide a system for initiating the expansion of the anchor that can be controlled by the bolt rod from the inside of the basement wall.

In the looser types of soil, it also may be necessary to increase the anchoring effect by the use of multiple anchor devices on the same bolt rod. This simply means increasing the number of the pivoted arms that become subject to earth pressure. These arms are analogous to the "flukes" common in marine anchors.

SUMMARY OF THE INVENTION

An expandable earth anchor is driven laterally into the ground on the end of a bolt rod. Rotation of the rod initiates expansion of the anchor, which then is fully expanded by pulling back on the bolt rod. The initial expansion is obtained by the engagement of a cam member carried by the bolt rod, acting against arms pivoted to a member in threaded engagement with the bolt rod. A plurality of the anchor devices, or sets of these arms, can be mounted on a single bolt rod, with the initiation of expansion being provided in one modification by the rotation of the rod to independently open the sets of arms; and in another modification of the invention, the initial expansion of one set of arms itself operates to initiate the expansion of another set of arms pivoted at a position axially spaced along the bolt rod from the first set.

DESCRIPTION OF THE DRAWINGS

FIG. 6 is taken on the plane VI—VI of FIG. 5.

DESCRIPTION OF THE PREFERRED EMBODIMENTS

Figure 1:
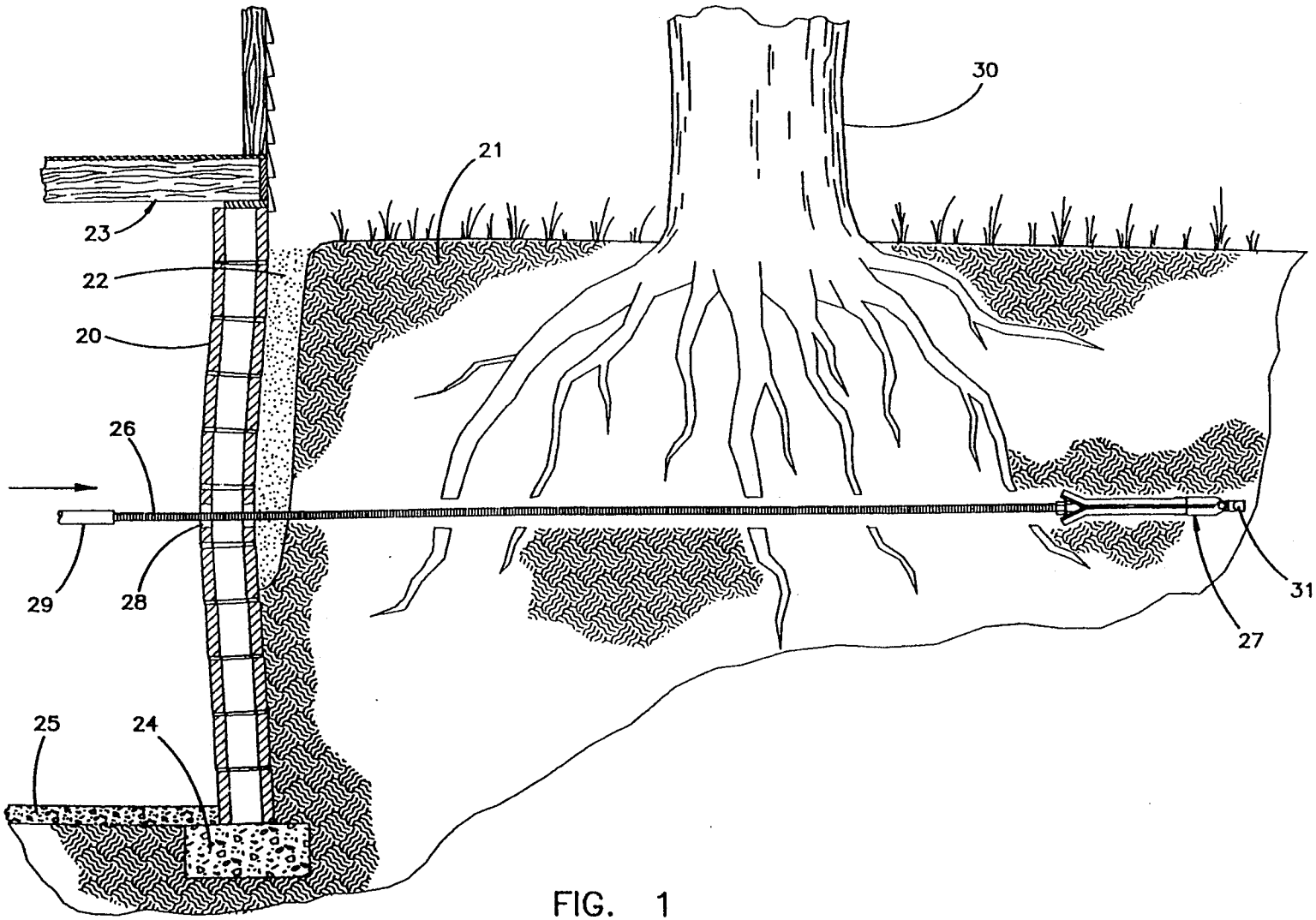
FIG. 1 is a sectional elevation showing a typical installation of an anchor device on a long bolt rod for the purpose of restoring a basement wall to a vertical plane.
Figure 2:
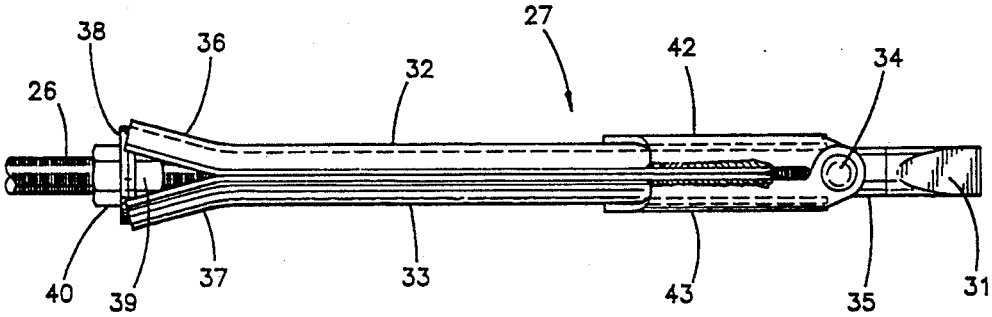
FIG. 2 is a side elevation on a scale enlarged over that of FIG. 1, showing the anchor device in the initial fully closed position.

Referring to FIG. 1, the cement block basement wall 20 is shown bowed inward to a precarious degree, as a result of the previous freezing and expansion of the earth 21, followed by the thawing shrinkage producing a gap 22 between the earth and the outside of the wall. This gap has become partially filled, and presumably will eventually accumulate more loose soil to the point where the gap will be substantially closed. A successive period of freezing will thus produce the expansion of the soil 21, and apply renewed pressure on the already deflected wall 20. The house structure indicated generally at 23 is thus under considerable risk, as the deflected wall is no longer capable of carrying the weight of the house down to the footing 24. The bowed condition of the wall 20 also invites an assortment of cracks through which moisture can pass from the exterior of the wall into the basement to accumulate on the basement floor 25, where it may well cause considerable damage and inconvenience.

The wall condition shown in FIG. 1 can be corrected by a system which includes the threaded bolt rod 26 and the earth anchor 27. A hole shown at 28 of approximately 4 inches in diameter is first drilled through the wall 20. The bolt rod 26, or a section of it carrying the anchor device 27, is then inserted from the interior of the basement through the hole 28. A coupling 29 then is connected to an air hammer, and the assembly shown in FIG. 1 driven from left to right out into the illustrated position in the earth. During this movement, the anchor device 27 remains in the un-expanded condition. Since the device may have to find its way through the root growth of trees as shown at 30, the anchor device is provided with a chisel point 31 to facilitate this movement.

Referring to FIGS. 2–5, the anchor device 27 includes a pair of opposite arms 32 and 33 pivotally connected by the bolt 34 to the threaded tubular member 35. The trailing ends of the arms 32 and 33 are flared as shown at 36 and 37 to receive the washers 38 entrapped between the nuts 39 and 40. After the assembly shown in FIG. 1 has been driven into the illustrated position, the bolt rod 26 is rotated. The threaded interengagement between the rod 26 and the internally threaded tubular member 35 causes the nuts 39 and 40 to carry the washers 38 from the FIG. 2 to the FIG. 3 position. The nuts 39 and 40 had initially been set against each other sufficiently tight so that rotation of the rod will rotate these components along with it. It is preferable that the nuts should be set against each other to at least 100 foot pounds of torque. The movement from the FIG. 2 to the FIG. 3 position causes the washers 38 to function as cams acting against the central concave underside of the arms 32 and 33, inducing the degree of expansion illustrated in FIG. 3, where further movement of the rod into the tubular member 35 is halted by the engagement of the nut 39 with the outer end of the tubular member. Initially, the threaded rod 26 is engaged with only an inch or so of the outer extremity of the tubular member 35. The central concave portion (from the inside) shown at 41 of the arms is preferably of approximately the same curvature is that of the periphery of the washers 38. This tends to provide the best bearing surface, and also increases the tendency for the pivoted arms to remain in alignment as the assembly is driven into position.

Figure 5:
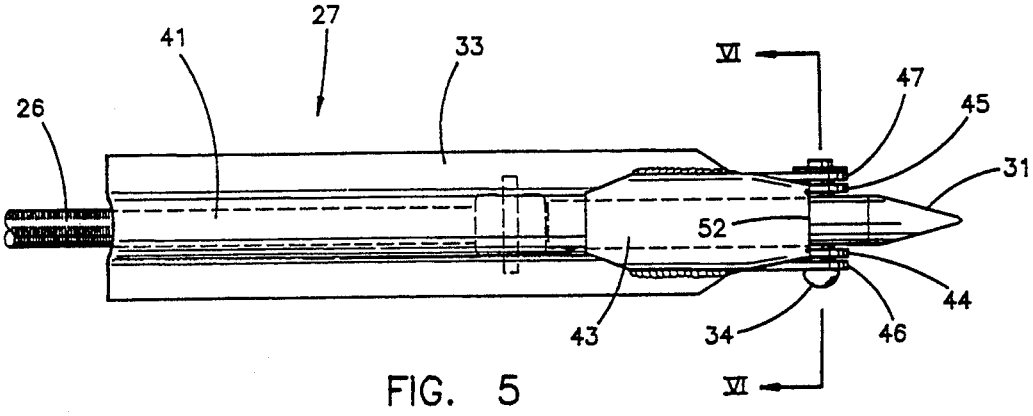
FIG. 5 is a top view of the anchor device shown in FIGS. 2 and 3.
Figure 6:
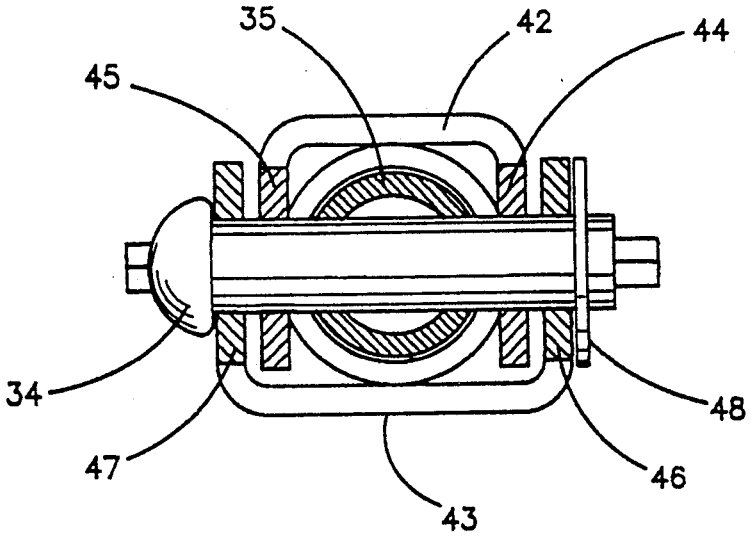
FIG. 6 is a sectional elevation on a plane taken through the pivot bolt securing the expandable arms.

Referring to particularly to FIGS. 5 and 6, the arms 32 and 33 are reinforced by the channel-shaped pivot members 42 and 43, in which the side flanges are extended as shown at 44–47 to receive the pivot bolt 34. These side flanges are welded to the arms 32 and 33, and the bolt 34 is also preferably welded in position at its opposite ends, together with the retainer washer 48.

Figure 3:
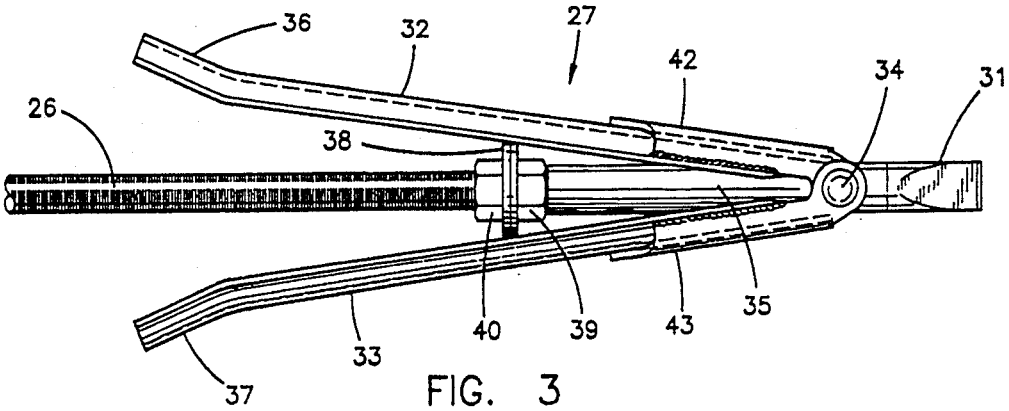
FIG. 3 illustrates the anchor device of FIG. 2 in the partially expanded condition.
Figure 4:
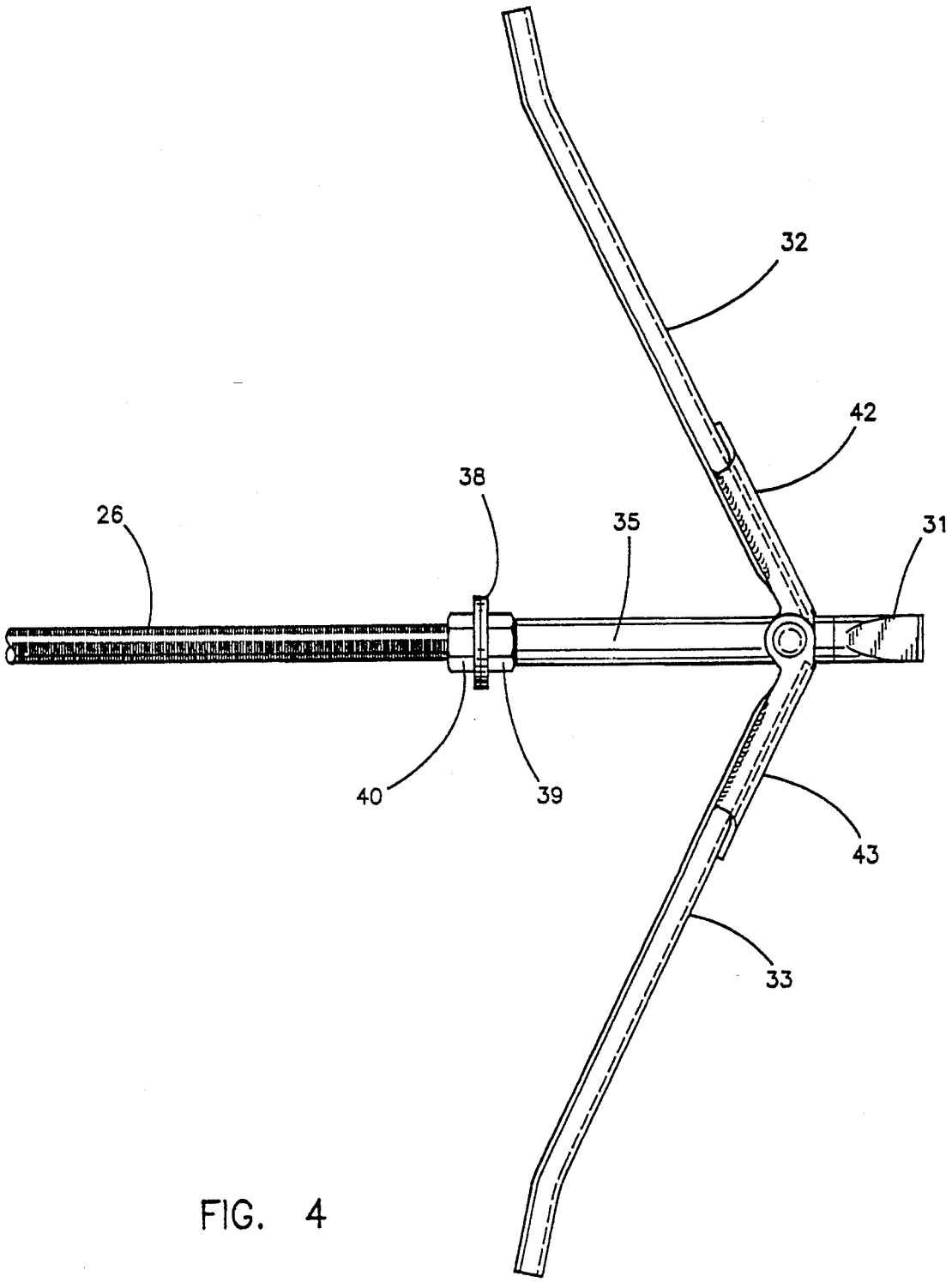
FIG. 4 illustrates the same device as shown in FIGS. 2 and 3, and in the fully expanded condition.
Figure 9:
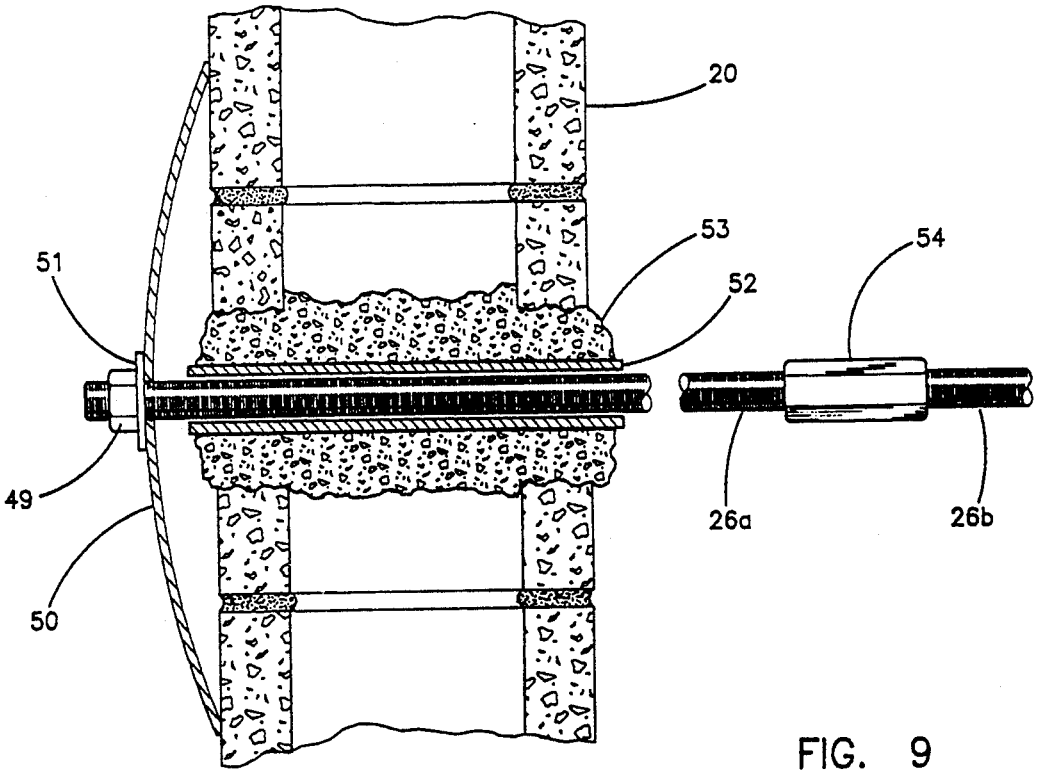
FIG. 9 is a fragmentary sectional view at the basement wall, showing the installation of the bearing plate and the associated nut used for applying the force to the wall, and showing a seal at the hole drilled through the wall for the installation of the anchor.
Figure 10:
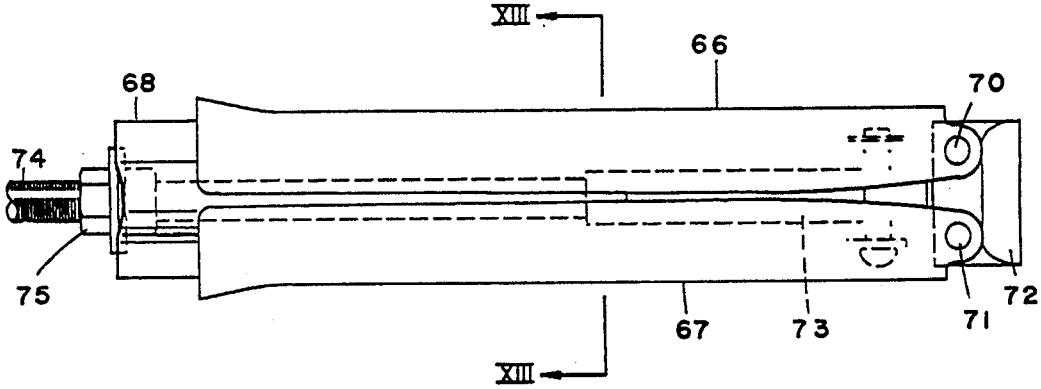
FIG. 10 is a perspective view of a further modification of the invention, showing overlapped sets of pivoted arms, shown in the fully closed position.
Figure 13:
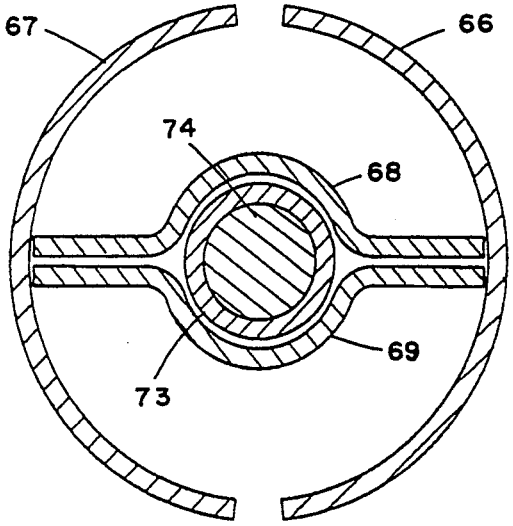
FIG. 13 is a section on the plane XIII—XIII of FIG. 10.
Figure 11:
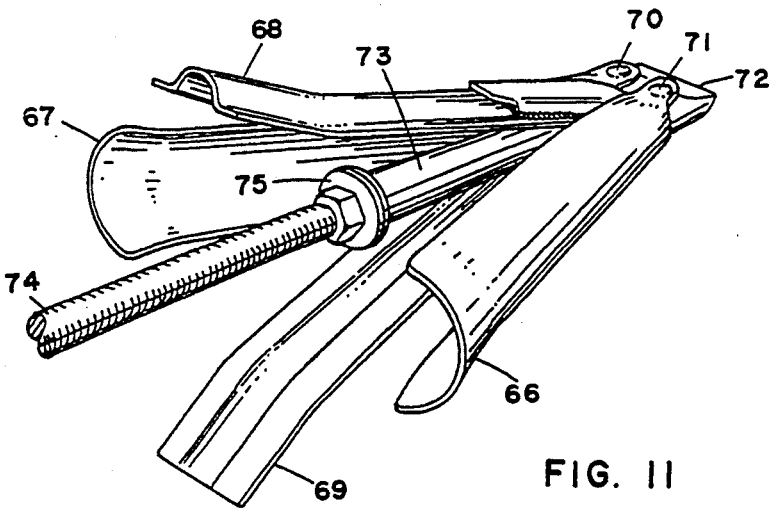
FIG. 11 is a perspective view of the partially opened anchor illustrated in FIG. 10.
Figure 12:
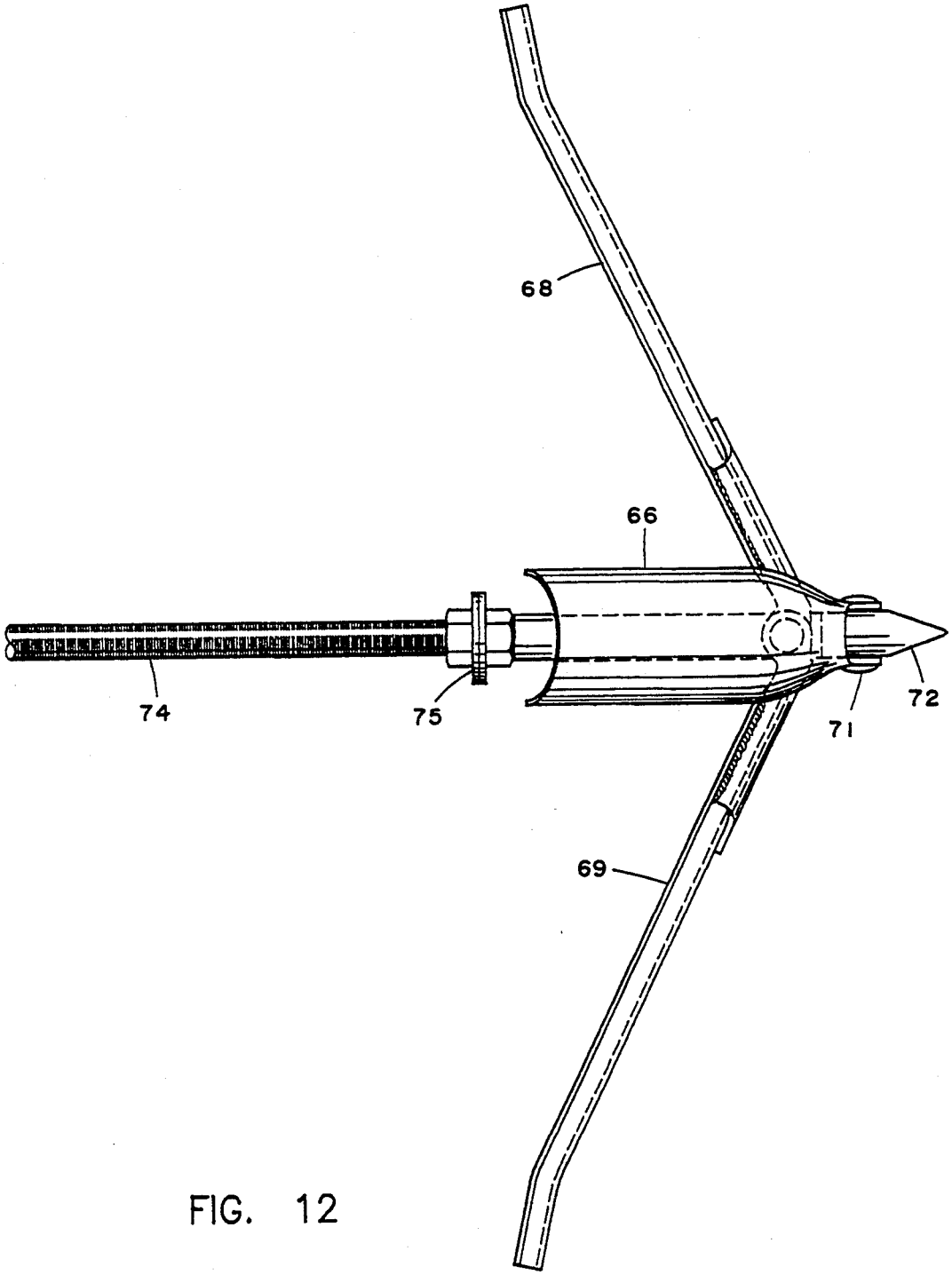
FIG. 12 is a perspective view showing the fully opened condition of the anchor device of FIGS. 10 and 11.

Once the expansion of the anchor has been initiated to the point shown in FIG. 3, a pull on the rod 26 exerted by tightening the nut 49 against the surface plate 50, possibly through the intervening washer 51, will cause the entire anchor assembly to move toward the basement wall to ultimately achieve the fully expanded condition shown in FIG. 4. At this point, the edges 52 will engage the outer surface of the threaded tubular member 35 to form stops limiting any further rotation of the arms. The pressure of the nut 49 against the plate 50 becomes a resilient force, due to the inwardly concave configuration of this member. It is preferable that the plate 50 be of a material similar in nature to spring steel, and it has been found very effective to use agricultural cultivator discs (without the sharpened edges) for this purpose. If desired, the initial hole 28 in the block wall 20 may be filled with mortar or sealant, to inhibit the outflow of water through this opening. To permit the nut 49 to be tightened, accompanied by further movement of the threaded rod to the left, it is necessary that there be no effective bond between the rod and any surrounding mortar. To prevent this, a cardboard (or other inexpensive material) tube 52 may be inserted around the rod prior to packing in the sealant material, or mortar, shown at 53. During the installation of this assembly, it may be convenient to break the rod 26 into sections, as shown at **26*a* and 26*b* in FIG. 9, interconnected by a standard coupling 54**.

The proportions of the anchor components can vary over a considerable range, depending on the requirements of particular installations. For general use, a bolt rod ¾" in diameter with standard coarse threading is adequate. The pivot pins should be about ⅜" to ½" in diameter, and the pivot reinforcements for the arms of material slightly thicker than the outer extremities of the arms, which can be about ⅛". All of these components are of steel. The length of the arms should be in the neighborhood of one foot as a maximum for good holding capability.

Figure 7:
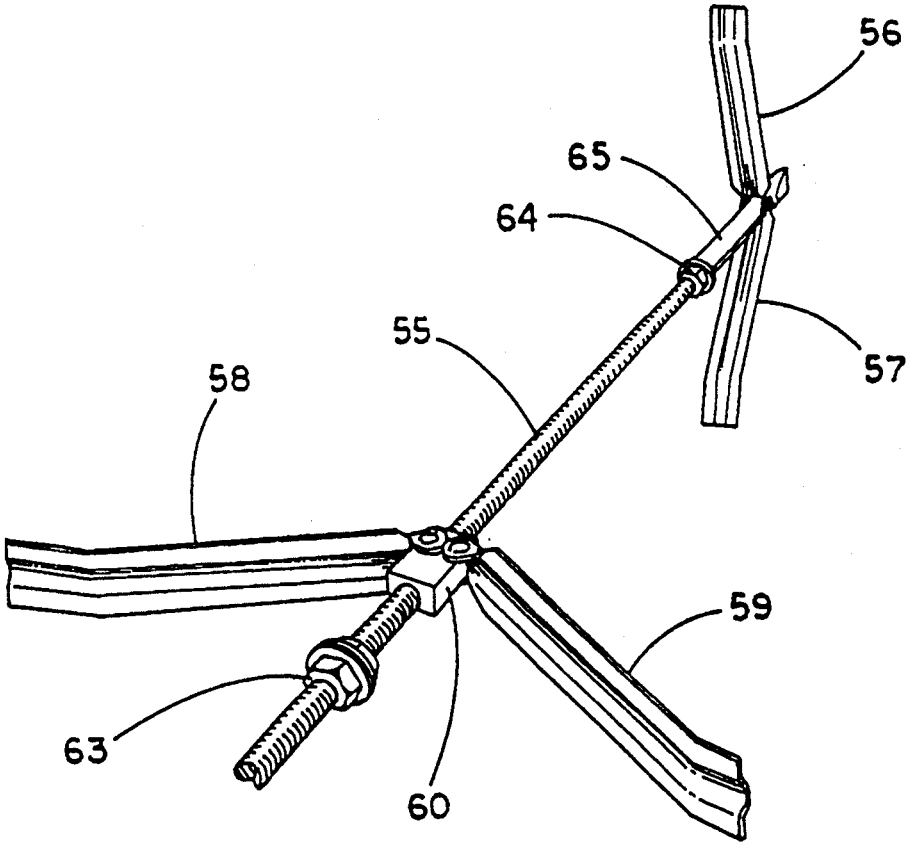
FIG. 7 is a view of a modified form of the invention involving a succession of independent anchor devices installed on a common bolt rod.
Figure 8:
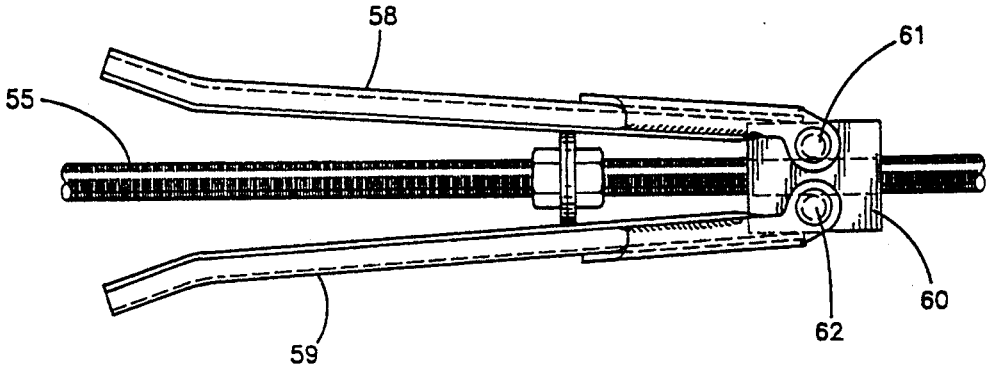
FIG. 8 is a plan view of an anchor device of the type shown FIG. 7, in the partially expanded condition, and on an enlarged scale over that of FIG. 7.

FIGS. 7 and 8 show a modified form of the invention, in which a single threaded rod 55 is capable of independently actuating the initial expansion of separate pairs of pivoted arms, as shown at 56–57 and 58–59. The plates 58 and 59 are pivotally connected to the internally threaded block 60 on pins 61 and 62 which are laterally displaced from the axis of the rod 55 sufficiently that they do not intersect the rod. The rod is thus left free to continue on through the outer anchor, and actuate the inner anchor (including the arms 56 and 57) as previously described. The limitation of the threaded engagement of the rod 55 with respect to the anchors can be provided either by engagement of the nut-washer assemblies 63 or 64 with the end of the block 60 or that of the threaded tubular member 65. In either case, this engagement will prevent further threaded entrance of the rod 55 into the anchor system. The extent of this axial movement will have been sufficient to open both anchors.

Referring to FIGS. 10–13, a modified form of the invention is illustrated in which overlapping pairs of pivoted arms 66–67 and 68–69 are used. The outer arms are mounted on pivot pins 70 and 71 traversing the chisel block 72 secured to the end of the internally threaded member 73. The inner pair of arms 66–67 are carried by a pivot pin traversing the tubular member 73 as shown in FIG. 3. The outer set of arms closes down over the inner set of arms 68 and 69. The initial expansion of these arms is initiated as before, by rotation of the rod 74 with respect to the threaded tubular member 73, and the corresponding advance of the nut-washer assembly 75 between the arms 68 and 69. The expansion of those arms induces the expansion of the arms 66 and 67.

We claim:

1. An earth anchor including an internally threaded member having an axis and at least one arm pivotally connected to said internally threaded member for movement from a first position substantially parallel to said axis to a second position extending laterally from said axis, stop means operative to establish said second position, and an externally threaded member in engagement with said internally threaded member and extending to a remote position for transfer of linear forces, wherein the improvement comprises:

abutment means disposed at an intermediate point on said externally threaded member; and cam means axially fixed with respect to said abutment means, and operative to engage said arm on relative axial movement of said cam means toward said internally threaded member on relative rotation in a selected direction between said members to induce movement of said arm from said first position toward said second position.

2. An earth anchor as defined in claim 1, wherein said arm has an internal surface inclined to said axis in said first position, and said cam means is engageable with said inclined surface on movement toward said internally threaded member.

3. An earth anchor as defined in claim 2, wherein said cam means is rotatively fixed on said externally threaded member, and has a circular periphery.

4. An earth anchor as defined in claim 1, wherein said abutment means is a pair of opposed nuts engaging said externally threaded member.

5. An earth anchor as defined in claim 4, wherein said can means is at least one washer interposed between said nuts.

6. An earth anchor as defined in claim 1, additionally including a second internally threaded member in engagement with said externally threaded member at a position spaced axially from said first specified internally threaded member, and also including second cam means axially fixed with respect to said externally threaded member, and at least one second arm pivotally mounted on said second internally threaded member for movement between a first position substantially parallel to said axis to a second position extending laterally from said axis to a limit position, said second cam means being operative to induce movement of said second arm from said first position toward said second position on relative axial movement of said second cam means toward said second internally threaded member.

7. An earth anchor as defined in claim 6, wherein said first and second arms are mounted for movement in planes angularly displaced about said axis.

8. An earth anchor as defined in claim 6, wherein said second arm is pivotably connected to said second internally threaded member on a pin transverse to and spaced laterally from said externally threaded member.

9. An anchor as defined in claim 1, additionally including an interior bearing plate having resilience in a direction parallel to said externally threaded member, and having a central hole traversed by a member axially connected thereto, and further including bearing nut means in threaded engagement with said connected member.

10. An anchor as defined in claim 1, additionally including at least one second arm pivotally connected to said internally threaded member on an axis angularly spaced therefrom about said axis, said second arm being disposed to overlap said first-specified arm in said first position.

* * * * *